US006808294B2

(12) United States Patent
Pazula et al.

(10) Patent No.: US 6,808,294 B2
(45) Date of Patent: Oct. 26, 2004

(54) COLLAPSIBLE LAMPSHADE

(75) Inventors: Bruce Raymond Pazula, Broadview Heights, OH (US); Chen Changda, Changhai (CN); Kevin Lee Von Kluck, Cleveland, OH (US)

(73) Assignee: The L. D. Kichler Co., Cleveland, OH (US)

( * ) Notice: Subject to any disclaimer, the term of this patent is extended or adjusted under 35 U.S.C. 154(b) by 1 day.

(21) Appl. No.: 10/273,863

(22) Filed: Oct. 18, 2002

(65) Prior Publication Data

US 2004/0076012 A1 Apr. 22, 2004

(51) Int. Cl.[7] ..... F21V 1/06
(52) U.S. Cl. ..... 362/352; 362/356; 362/357
(58) Field of Search ..... 362/352, 356, 362/357, 450, 433, 434, 440

(56) References Cited

U.S. PATENT DOCUMENTS

| | | | | |
|---|---|---|---|---|
| 3,180,982 A | | 4/1965 | Derman et al. | |
| 4,354,222 A | | 10/1982 | Gall | 362/352 |
| 4,718,402 A | | 1/1988 | Fordyce | 126/337 |
| 5,375,048 A | * | 12/1994 | Barnes | 362/352 |
| 6,315,434 B1 | | 11/2001 | Long | 362/352 |
| 6,386,739 B1 | | 5/2002 | Wu | 362/450 |
| 6,443,599 B1 | | 9/2002 | Wu | 362/352 |
| 6,443,600 B1 | | 9/2002 | Wu | 362/352 |
| 2002/0085382 A1 | | 7/2002 | Wu | 362/358 |
| 2002/0085383 A1 | | 7/2002 | Wu | 362/450 |

* cited by examiner

*Primary Examiner*—Alan Gariaso
*Assistant Examiner*—Guiyoung Lee
(74) *Attorney, Agent, or Firm*—Calfee, Halter & Griswold LLP

(57) ABSTRACT

A lampshade having an assembled state and a collapsed state includes a first ring, a second ring spaced apart from the first ring when the lampshade is in the assembled state, and a first fabric covering interconnecting the first and second rings. A third ring is located adjacent the first ring when the lampshade is in the assembled state. A plurality of supports are connected between the second ring and the third ring. Each support has a first end portion movably connected to the second ring and a second end portion movably connected to the third ring. The supports hold the second and third rings spaced from each other. The supports urge the third ring into engagement with the first ring thereby to hold the first ring spaced apart from the second ring.

20 Claims, 6 Drawing Sheets

COLLAPSIBLE LAMPSHADE

TECHNICAL FIELD

The present invention relates to the field of illumination, and in particular to a collapsible or folding light modifier in the form of a shade. Specifically, the present invention relates to a lampshade that can be collapsed to save space for storage and shipping, then expanded for use.

BACKGROUND OF THE INVENTION

Collapsible lampshades are known in the art. As one example, Derman U.S. Pat. No. 3,180,982 shows a collapsible lampshade having a frame that includes an upper ring and a lower ring interconnected by a plurality of circumferentially spaced flat bandlike springs. The lamp shade has a single, outer fabric covering that conforms to the contour of the springs.

SUMMARY OF THE INVENTION

The present invention relates to a lampshade having an assembled state and a collapsed state. The lampshade comprises a first ring, a second ring spaced apart from the first ring when the lampshade is in the assembled state, and a first fabric covering interconnecting the first and second rings and extending between the first and second rings when the lampshade is in the assembled state. A third ring is located adjacent the first ring when the lampshade is in the assembled state. A plurality of supports are connected between the second ring and the third ring. Each one of the supports has a first end portion movably connected to the second ring and a second end portion movably connected to the third ring. The supports hold the second and third rings spaced from each other when the lampshade is in the assembled state. The supports urge the third ring into engagement with the first ring thereby to hold the first ring spaced apart from the second ring when the lampshade is in the assembled state.

BRIEF DESCRIPTION OF THE DRAWINGS

The foregoing and other features of the present invention will become apparent to one skilled in the art to which the present invention relates upon consideration the following description of the invention with reference to the accompanying drawings, in which.

DETAILED DESCRIPTION OF THE INVENTION

Figure 1:
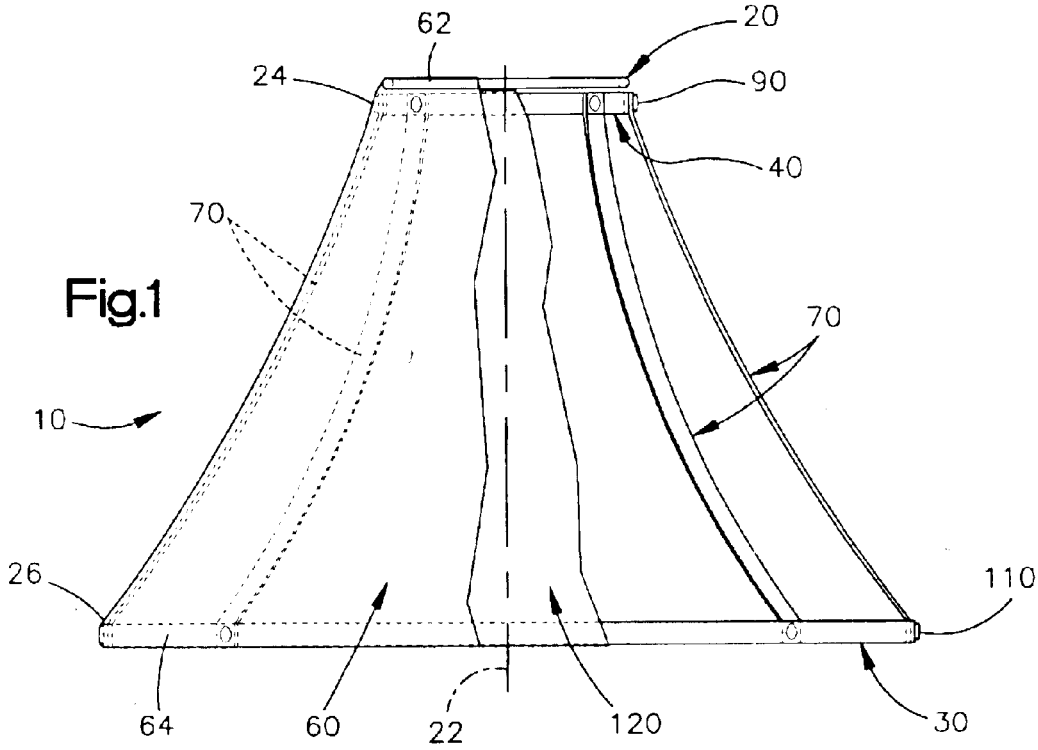
FIG. 1 is an elevational view, with the fabric coverings partially broken away, of a lampshade in accordance with a first embodiment of the present invention, including a frame and inner and outer fabric coverings, shown in an assembled state.
Figure 2:
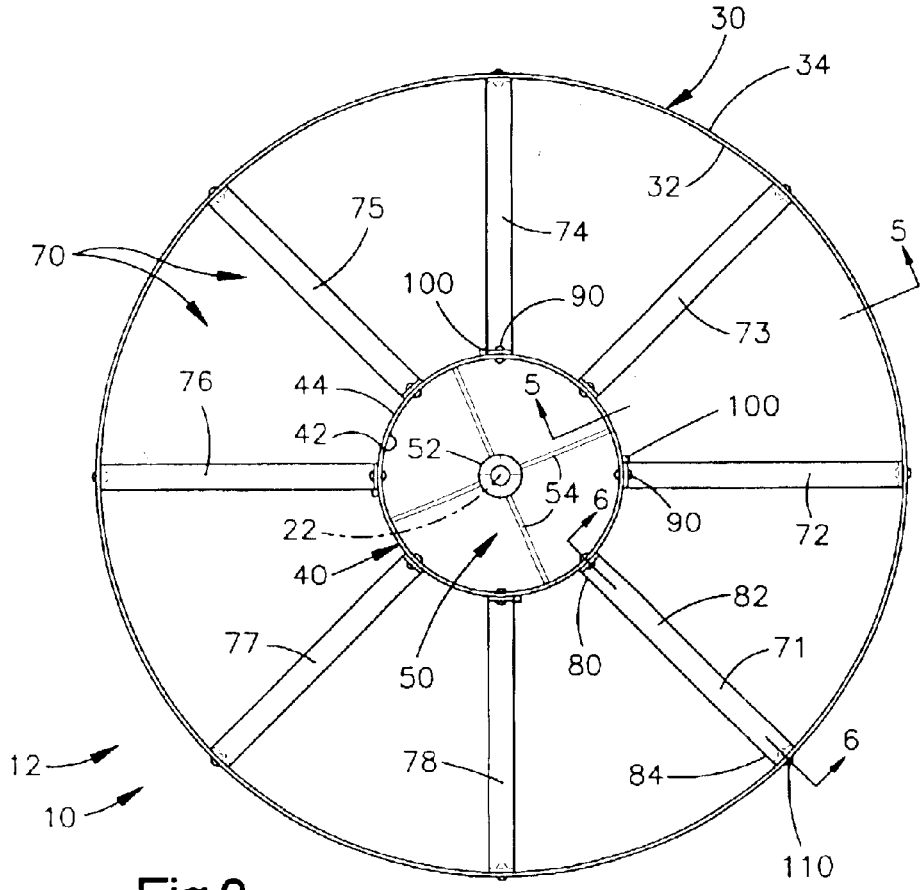
FIG. 2 is top plan view of the frame of the lampshade of FIG. 1 shown in the assembled state.

The present invention relates to a collapsible lampshade. In particular, the present invention relates to a lampshade that can be collapsed to save space for storage and shipping, then expanded, or assembled, for use. The present invention is applicable to various different lampshade constructions. As representative of the present invention, FIG. 1 illustrates a lampshade 10 constructed in accordance with a first embodiment of the invention.

The lampshade 10 includes a frame 12. The frame 12 includes a top ring 20, a bottom ring 30, a third ring 40, and a plurality of supports 70. The lampshade 10 also includes an outer fabric covering 60 and an inner fabric covering 120.

The top ring, or first ring, 20 is preferably made from a metal, such as steel or brass. The top ring 20 could, alternatively, be made from a different material, such as plastic. The top ring 20 (FIGS. 1–4) in the illustrated embodiment has a circular overall configuration centered on a central axis 22 of the lampshade 10.

Figure 7:
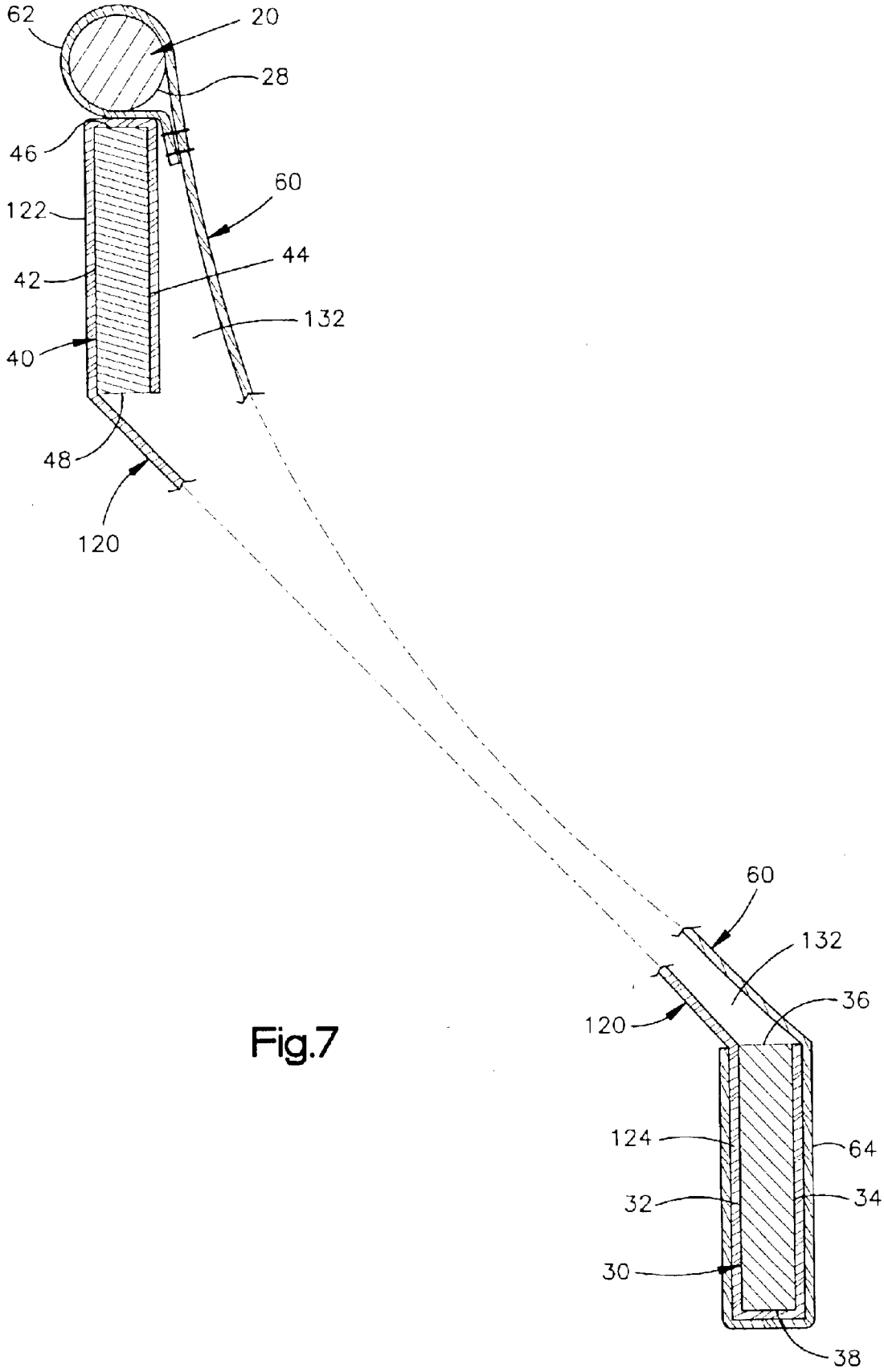
FIG. 7 is an enlarged view of portions of FIG. 5.
Figure 8:
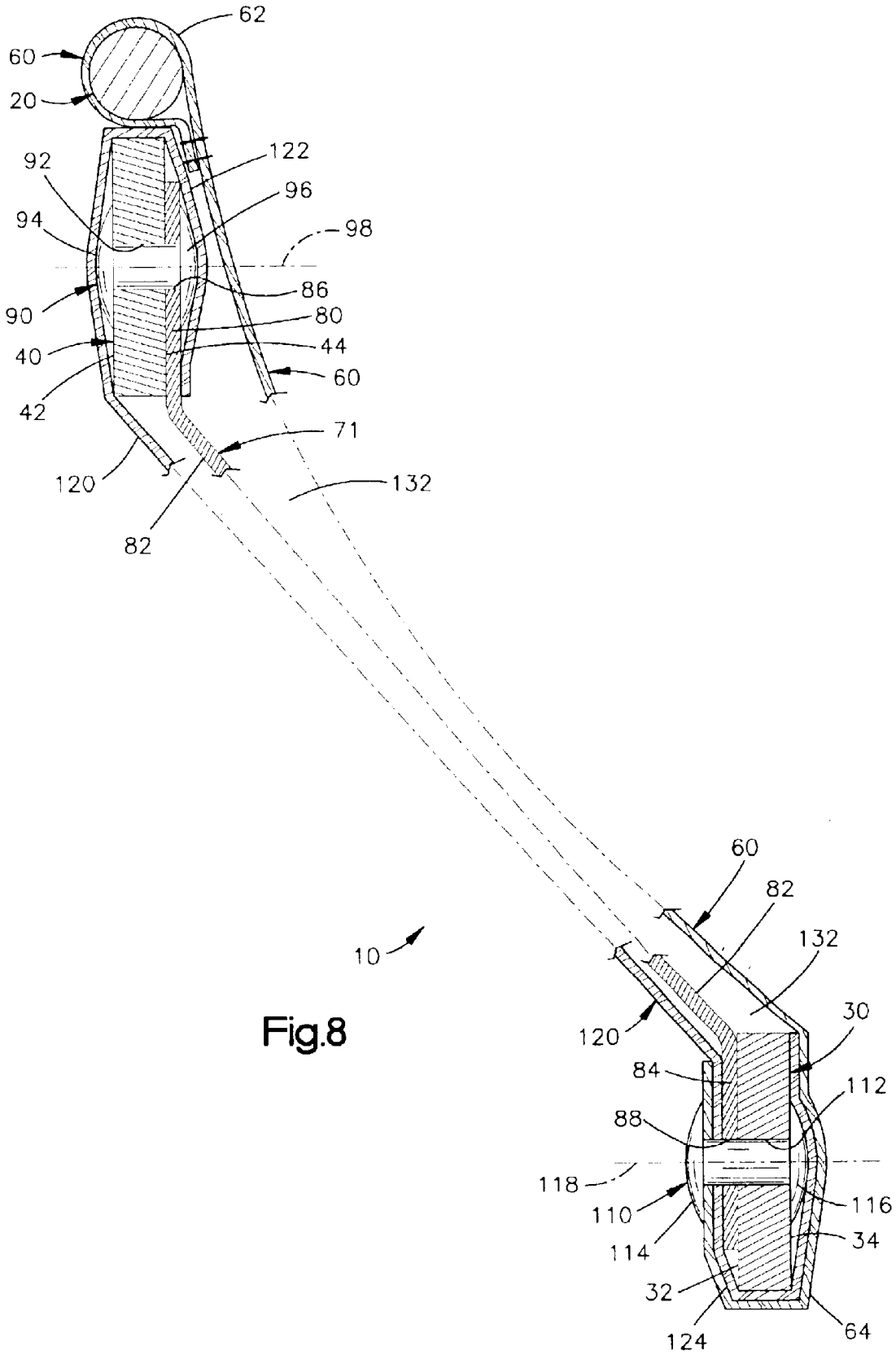
FIG. 8 is an enlarged view of portions of FIG. 6.
Figure 9:
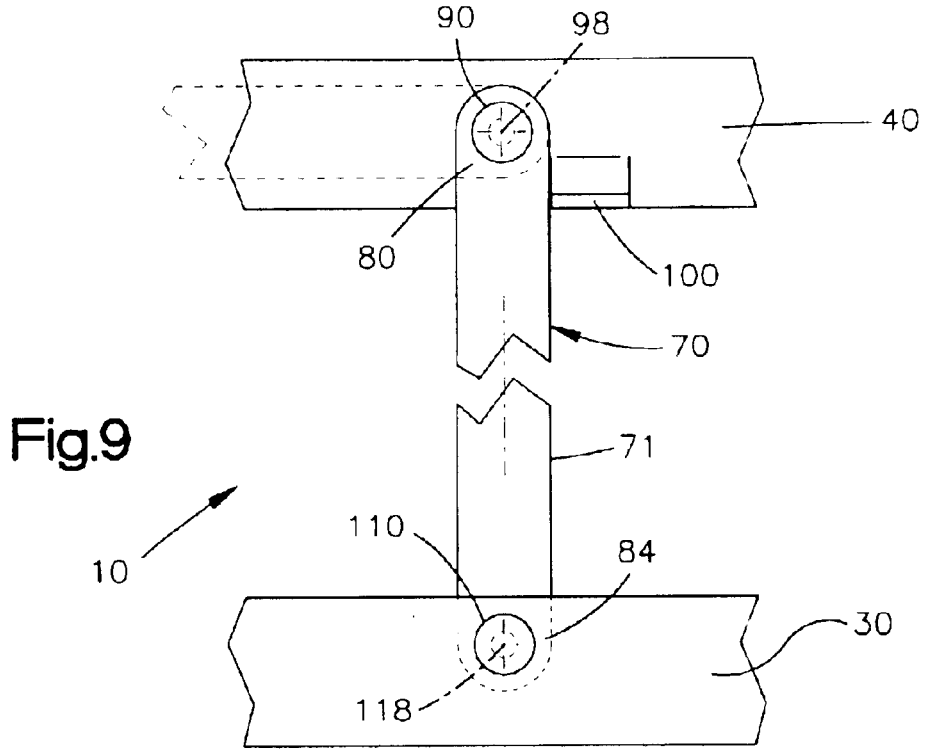
FIG. 9 is an enlarged schematic view showing the attachment of certain parts of the frame of the lampshade.

The overall configuration of the top ring 20 is based on, and sets, the configuration of the top edge portion of the lampshade. In the illustrated embodiment, for example, the lampshade 10 has a circular top edge portion 24 and a circular bottom edge portion 26; the top ring 20 has a circular overall configuration. The top ring 20 could have a different overall configuration; for example, a lampshade having a "square" overall configuration would have a square top ring, and a lampshade 10 having an "octagonal" overall configuration would have an octagonal top ring. The top ring 20 can be made from metal wire and in the illustrated embodiment has a circular cross-sectional configuration (FIG. 7) with a cylindrical outer side surface 28.

The bottom ring, or second ring, 30 is preferably made from the same material as the top ring. The bottom ring 30 (FIGS. 1–4) typically has the same overall configuration as the top ring 20. Thus, the bottom ring 30 in the illustrated embodiment has a circular overall configuration centered central on the axis 22 of the lampshade 10.

The radius of curvature of the bottom ring 30 about the central axis 22 of the lampshade 10 is substantially greater than the radius of curvature of the top ring 20 about the central axis. This difference provides the assembled lampshade 10 with a substantially larger diameter at its bottom edge portion 26 than at its top edge portion 24. In the alternative, the top and bottom rings can be substantially the same size. As yet another alternative, the entire shade can be made upside-down, with a single ring at the top and a pair of adjacent rings at the bottom. In this last alternative, the spider can extend from the single, upper ring.

The bottom ring 30 (FIG. 7) has a rectangular cross-sectional configuration including parallel, cylindrical, axially extending inner and outer side surfaces 32 and 34. The bottom ring 30 also has parallel, annular, radially extending top and bottom side surfaces 36 and 38. The axial length of the inner and outer side surfaces 32 and 34 is significantly greater than the radial length of the top and bottom side surfaces 36 and 38.

The third ring 40 (FIG. 7) is preferably made from the same material as the top ring 20 and the bottom ring 30. The third ring 40 is preferably similar in construction to the bottom ring 30. The radius of curvature of the third ring 40 (FIGS. 2 and 4) about the central axis 22 of the lampshade 10 is substantially the same as the radius of curvature of the top ring 20 about the central axis, because the third ring is located adjacent to the top ring when the lampshade 10 is in the assembled state. As a result, the third ring 40 is smaller in diameter than the bottom ring 30, because the top ring 20 is smaller in diameter than the bottom ring.

The third ring 40 in the illustrated embodiment has a circular overall configuration centered on the central axis 22 of the lampshade 10. The overall configuration of the third ring 40 is the same as the overall configuration of the top ring 20 of the lampshade.

The third ring 40 (FIG. 7) has a rectangular cross-sectional configuration that is preferably the same as that of the bottom ring. The third ring 40 has parallel, cylindrical, axially extending inner and outer side surfaces 42 and 44. The third ring 40 has parallel, annular, radially extending top and bottom side surfaces 46 and 48. The axial length of the inner and outer side surfaces 42 and 44 is significantly greater than the radial length of the top and bottom side surfaces 46 and 48.

The lampshade 10 also includes a spider 50 (FIGS. 2 and 4) for supporting the lampshade on a lamp (not shown). The spider 50 includes a central hub 52, which connects with the lamp (not shown) that is disposed under the shade. The spider 50 also includes a plurality of radially extending arms 54 that fixedly interconnect the central hub and the third ring 40. Each one of the radial arms 54 of the spider 50 may have an L-shaped configuration when viewed in elevation to provide the frame 12 with the industry standard "drop" of one half inch between the third ring 40 and the central hub 52. When the central hub 52 of the spider 50 is connected with the lamp, the spider supports the third ring 40 on the lamp. The third ring 40, in turn, supports the remainder of the lampshade 10.

The outer fabric covering 60 (FIGS. 1, 3, and 5–8) is a decorative exposed portion of the lampshade 10, and serves to direct and diffuse light generated by the lamp to which the lampshade is attached. The outer fabric covering 60 may be of the type common in such lampshades. The outer fabric covering 60 may be of a cloth material or may be of another material, for example, plastic.

The outer fabric covering 60 has a first end portion or top end portion 62 (FIGS. 7 and 8) that is wrapped around the top ring 20. The top end portion 62 of the outer fabric covering 60 is sewn or glued or otherwise adhered to itself and/or to the top ring 20. The top end portion 62 of the outer fabric covering 60 is thereby fixedly secured to the top ring 20. The radially extending arms 54 of the spider 50 extend through gaps in the top end portion 62 of the outer fabric covering 60.

A second end portion or bottom end portion 64 of the outer fabric covering 60 is wrapped around the bottom ring 30. The bottom end portion 64 of the outer fabric covering 60 is sewn or glued or otherwise adhered to itself and/or to the bottom ring 30. The bottom end portion 64 of the outer fabric covering 60 is thereby fixedly secured to the bottom ring 30. The outer fabric covering 60 as illustrated is irremovably attached to the top ring 20 and to the bottom ring 30, but may, alternatively, be removably attached.

The lampshade 10 includes a plurality of supports designated as a group with the reference numeral 70. The illustrated lampshade 10 includes eight supports 71, 72, 73, 74, 75, 76, 77 and 78. It should be understood that a lampshade 10 in accordance with the present invention could use more than eight supports, or fewer than eight supports.

The supports 71–78 extend between and interconnect the bottom ring 30 and the third ring 40. The supports 70 support the third ring 40 in a plurality of different positions relative to the bottom ring 30, as the lampshade 10 is moved between its collapsed state and its assembled state, in a manner as described below in detail.

In the illustrated embodiment, the eight supports 71–78 are identical to each other. Because the supports 71–78 are identical, corresponding parts of the supports are given identical reference numerals, and only the one support 71 is described in detail.

The support 71 is preferably formed from a single piece of material. A preferred material is carbon steel having an American Iron and Steel Institute designation of AISI C-1065 or UNS designation of G10650. The steel has a composition and is treated to provide the support with the desired resilience or elastic characteristics. Other materials can be used. For example, two other materials that have been found to be suitable are 42B steel available in Taiwan (HRC34-38 after heat treatment), and 304H stainless steel (HRC37-39 after heat treatment). The chosen material will have the desired resilience and strength needed for the particular size of lampshade. Material choice will also depend on availability at the location of manufacture.

In the embodiment illustrated in FIGS. 1–9, the support 71 is formed as a band. Dimensions of one exemplary support band 71 constructed in accordance with the invention include a width of about 8 to 9 millimeters and a thickness of about 0.7 millimeters to 1.0 millimeters. The support 71 is about 280 millimeters long. Obviously bands of other sizes can be used for differently sized shades.

The support 71 (FIGS. 2, 4 and 8–9) has a first end portion 80, a main body portion 82, and a second end portion 84. The first end portion or upper end portion 80 of the support 70, and includes a circular upper mounting opening 86. The upper end portion 80 of the support 71 forms a mounting portion for mounting, or connecting, the support with the third ring 40 of the lampshade 10 as described below.

The second end portion or lower end portion 84 of the support 71 includes a circular lower mounting opening 88. The lower end portion 84 is preferably bent at about a 20 degree to 30 degree angle to the main body portion 82 of the support 71. The lower end portion 84 of the support 71 forms a mounting portion for mounting, or connecting, the support with the bottom ring 40 of the lampshade 10 as described below.

The upper end portion 80 of the support 71 is connected to the third ring 40. In the illustrated embodiment, the upper end portion 80 of the support 71 is preferably connected to the third ring 40 with a rivet 90. The connection could alternatively be made in another manner.

The rivet 90 (FIG. 8) extends through the upper mounting opening 86 in the upper end portion 84 of the support 71 and through a corresponding mounting opening 92 in the third ring 40. The rivet 90 has inner and outer heads 94 and 96. The upper end portion 84 of the support 71 is disposed between the third ring 40 and the outer head 96 of the rivet 90, that is, on the outer side surface 44 of the third ring.

The rivet 90 does not pull the upper end portion 84 of the support 71 tightly against the third ring 40. As a result, the support 71 is movably connected to the third ring 40. Specifically, the support 71 is connected to the third ring 40 for pivotal movement relative to the third ring about an upper pivot axis 98 extending through the rivet 90.

The upper pivot axis 98 extends in a direction between the inner and outer side surfaces 42 and 44 of the third ring 40. The upper pivot axis 98 extends generally radially of the lampshade 10 and through the central axis 22 of the lampshade 10. The pivotal movement of the support 71 relative to the third ring 40 is, therefore, movement in a plane generally tangential to the third ring 40 at the location of the upper pivot axis 98 (the riveted connection). The support 71 can, as a result, pivot or swing between a plurality of different positions (orientations) relative to the third ring 40; the support does not have only one position relative to the third ring.

A plurality of stops 100 (FIGS. 2, 4 and 9) are preferably formed on the third ring 40. The stops 100 limit pivoting movement of the supports 70 relative to the third ring 40 and, thereby, relative to the bottom ring 30. In the illustrated embodiment, the supports 100 are formed as tabs bent radially outward from the material of the third ring 40, at locations adjacent four of the eight rivets 90.

The lower end portion 84 of the support 71 is connected to the bottom ring 30. In the illustrated embodiment, the lower end portion 84 of the support 71 is connected to the bottom ring 30 with a rivet 110. The connection could, alternatively, be made in another manner.

The rivet 110 (FIG. 8) extends through the mounting opening 88 in the lower end portion 84 of the support 71 and through a corresponding mounting opening 112 in the bottom ring 30. The rivet 110 has inner and outer heads 114 and 116. The lower end portion 84 of the support 71 is disposed between the bottom ring 30 and the inner head 114 of the rivet 110, that is, on the inner side surface 32 of the bottom ring.

The rivet 110 does not pull the lower end portion 84 of the support 71 tightly against the bottom ring 30. As a result, the support 71 is movably connected to the bottom ring 30. Specifically, the support 71 is connected to the bottom ring 30 for pivotal movement relative to the bottom ring about a lower pivot axis 118 extending through the rivet 110.

The lower pivot axis 118 extends in a direction between the inner and outer side surfaces 32 and 34 of the bottom ring 40. The lower pivot axis 118 extends generally radially of the lampshade 10 and through the central axis 22 of the lampshade. The pivotal movement of the support 71 relative to the bottom ring 30 is, therefore, movement in a plane generally tangential to the bottom ring at the location of the lower pivot axis 118. The support 71 can, as a result, pivot or swing between a plurality of different positions (orientations) relative to the bottom ring 40; the support does not have only one position relative to the bottom ring.

Figures 5, 6:
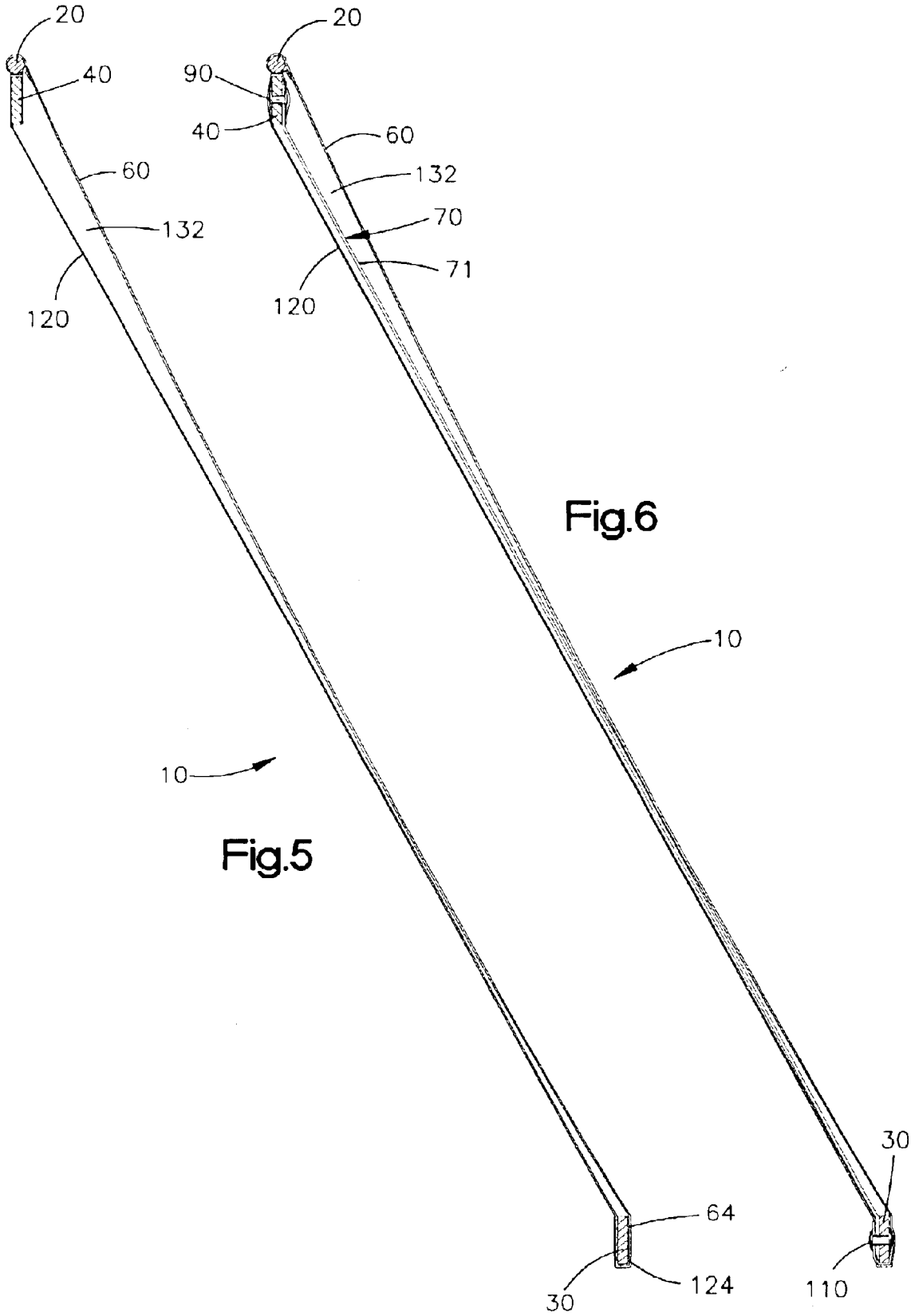
FIG. 5 is a sectional view of the assembled lampshade of FIG. 1, taken generally at the location of line 5—5 of FIG. 2.
FIG. 6 is a sectional view similar to FIG. 5 taken generally at the location of line 6—6 of FIG. 2.

Because the lower end portion 84 of the support 71 is bent at an angle to the main body portion 82 of the support, the main body portion of the support also extends inward of the bottom ring 30, in a direction toward the central axis 22, as can be seen, for example, in FIG. 5.

The supports 70 thus connect the third ring 40 to the bottom ring 30 with a movable connection. The third ring 40 is movable between a plurality of different vertical positions (along the central axis) relative to the bottom ring 30. The third ring 40 also is rotatable about the central axis 22 relative to the bottom ring 30 as it moves axially relative to the bottom ring.

For example, in FIGS. 1, 2, and 5–8, the third ring 40 is shown spaced apart from the bottom ring 30 by a first distance, in a direction parallel to the central axis 22 of the lampshade 10. Both the third ring 40 and the bottom ring 30 are centered on the central axis 22 of the lampshade 10. When the third ring 40 is spaced apart from the bottom ring 30 by the first distance, the supports 70 are fully extended, and the lampshade 10 is in the assembled condition.

Figure 3:
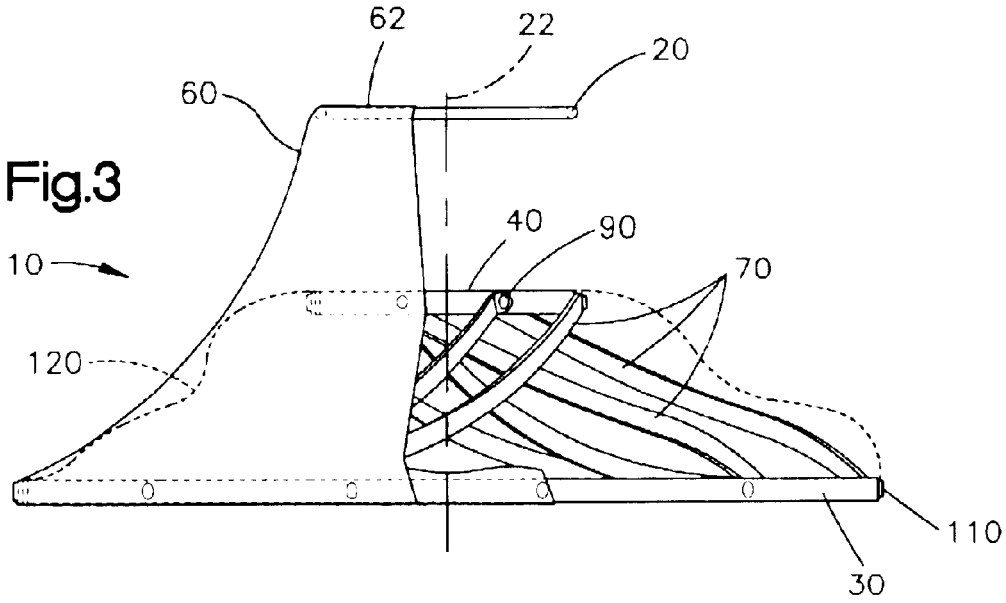
FIG. 3 is an elevational view, partially broken away, showing the lampshade of FIG. 1 in an intermediate state of assembly.

As another example, in the intermediate position of assembly shown in FIG. 3, the third ring 40 is spaced apart from the bottom ring 30 by a second distance, less than the first distance, in a direction parallel to the central axis 22 of the lampshade 10. Both the third ring 40 and the bottom ring 30 are centered on the central axis 22 of the lampshade 10. In addition, the third ring 40 is rotated about one-quarter of a turn (about 90 degrees) relative to the bottom ring 30, from the position shown in FIGS. 1, 2, and 5–8.

Figure 4:
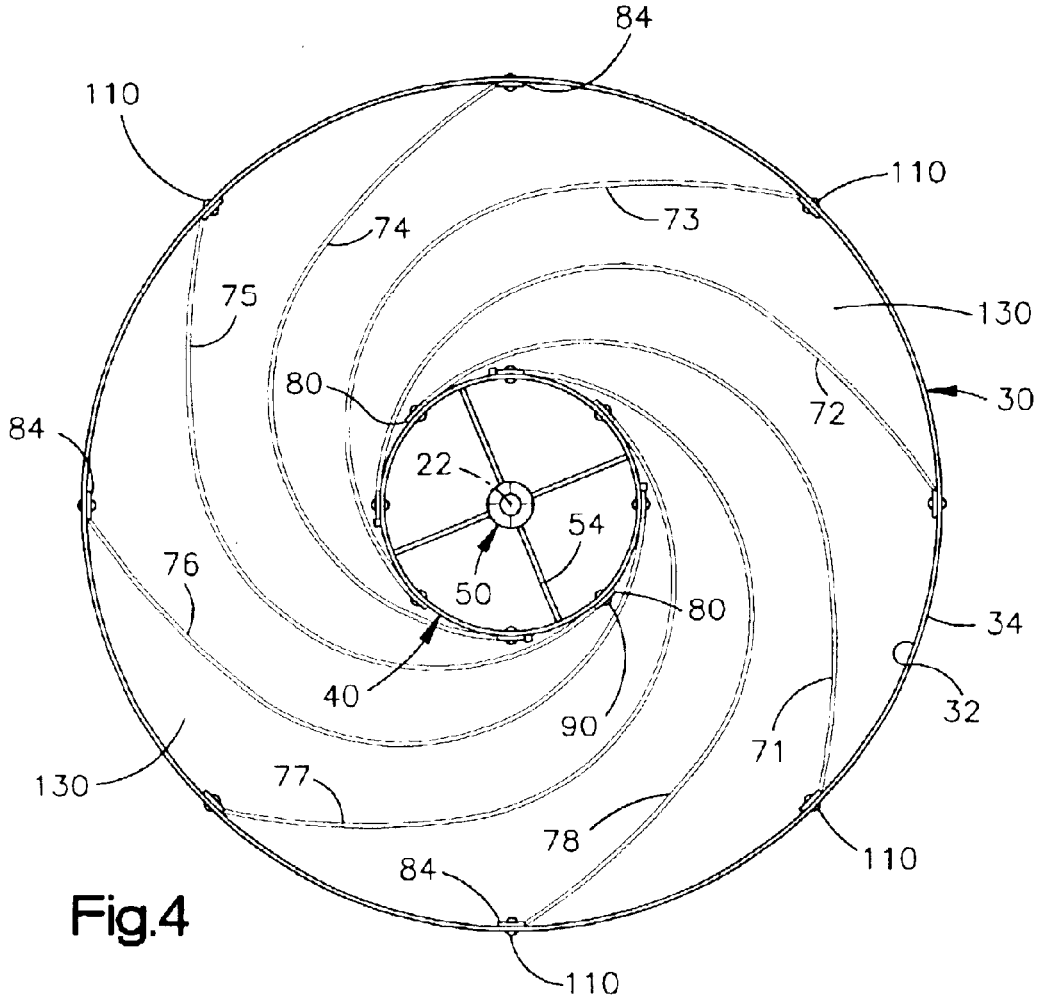
FIG. 4 is a top plan view of the frame of FIG. 2, shown in a collapsed state.

As yet another example, in the collapsed position shown in FIG. 4, the third ring 40 is shown in a position coplanar with the bottom ring 30. Both the third ring 40 and the bottom ring 30 are centered on the central axis 22 of the lampshade 10. In addition, the third ring 40 is rotated about one-half of a turn (about 180 degrees) relative to the bottom ring 30, from the position shown in FIGS. 1, 2, and 5–8.

When the third ring 40 moves axially relative to the bottom ring 30, the supports 70 pivot relative to the third ring and to the bottom ring. The upper end portions 80 of the supports 70 pivot relative to the third ring 40 about the upper pivot axes 98. The stops 100 limit the pivoting movement of the supports 70 relative to the third ring 40, so that the supports can not swing past the perpendicular. Simultaneously, the lower end portions 84 of the supports 70 pivot relative to the bottom ring 30 about the lower pivot axes 118.

In addition, when the third ring 40 moves axially relative to the bottom ring 30, the supports 70 bend, or flex. For example, when the third ring 40 is spaced apart from the bottom ring 30 by the first distance, that is, when the lampshade 10 is in the assembled state, the supports 70 have a generally linear configuration as viewed in elevation, as seen in FIG. 1. The supports 70 may be concave (as viewed in FIG. 1) to provide the lampshade 10 with its trumpet-shaped overall configuration seen in FIG. 1. When the third ring 40 is coplanar with the bottom ring 30 that is, when the lampshade is in the collapsed state, the supports 70 have a spiral, or arcuate, configuration, lying in the plane of the rings 40 and 30, as seen in FIG. 4.

The inner fabric covering 120 (FIGS. 1, 3, and 5–8) is connected between the third ring 40 and the bottom ring 30. The inner fabric covering 120 serves to direct and diffuse light generated by the lamp to which the lampshade is attached. The inner fabric covering 120 is typically made of a white fabric material that reflects light.

The inner fabric covering 120 has a first end portion or top end portion 122 (FIGS. 7 and 8) that is wrapped around the third ring 40. The top end portion 122 of the inner fabric covering 120 is sewn or glued or otherwise adhered to itself and/or to the third ring 40. The top end portion 122 of the inner fabric covering 120 is thereby fixedly secured to the third ring 40. The radially extending arms 54 of the spider 50 extend through gaps in the top end portion 122 of the inner fabric covering 120.

A second end portion or bottom end portion 124 of the inner fabric covering 120 is wrapped around the bottom ring 30. The bottom end portion 124 of the inner fabric covering 120 is sewn or glued or otherwise adhered to itself and/or to the bottom ring 30 and/or to the bottom end portion 64 of the outer fabric covering 60. The bottom end portion 124 of the inner fabric covering 120 is thereby fixedly secured to the bottom ring 30. The inner fabric covering 120 as illustrated is irremovably attached to the third ring 40 and to the bottom ring 30, but may, alternatively, be removably attached.

The lampshade 10 is movable between a collapsed state and an assembled or expanded state for use. When this movement occurs, the volume occupied by the lampshade 10 increases.

When the lampshade 10 is in the collapsed state (FIG. 4), the third ring 40 is preferably positioned in a plane with and radially inward of the bottom ring 30. A disc-shaped, annular space 130 is defined between the third ring 40 and the bottom ring 30. The supports 70 are pivoted relative to the third ring 40 and to the bottom ring 30 so that they lie in the annular space 130 defined between the third ring and the bottom ring.

The top ring 20 is adjacent to and parallel to the third ring 40 and the bottom ring 30. The outer fabric covering 60 extends loosely between the top ring 20 and the bottom ring 30. The inner fabric covering 120 extends loosely between the third ring 40 and the bottom ring 30. All the parts of the lampshade 10 are secured together. The volume of the lampshade 10 is minimized.

To expand, or assemble the lampshade 10, the top and bottom rings 20 and 30 are separated from each other axially, extending the outer fabric covering 60. The top ring 20 may be pulled away from the bottom ring 30. Then, the third ring 40 is separated from the bottom ring 30 axially. The third ring 40 is rotated and moved axially away from the bottom ring 30, in a direction toward the top ring 20. As this movement occurs, the supports 70 extend, from the collapsed state shown in FIG. 4, through the intermediate state shown in FIG. 3, to the fully extended state shown in FIGS. 1 and 5–8.

The elasticity or resilience of the supports 70 helps to move the third ring 40 relative to the bottom ring 30. The supports 70 tend to assume their extended position. Therefore, as the third ring 40 is being lifted or moved away from the bottom ring 30, the supports "unwind" and assist this movement. In this sense, then, the supports 70 may be said to act as springs.

When the supports 70 when fully extended are fully extended, the supports hold the third ring 40 and the bottom ring 30 spaced from each other. The supports 70 resist movement out of their extended position. The third ring 40 must be rotated about the central axis 22 in order to enable the third ring to be moved closer to the bottom ring 30.

In addition, the supports 70 urge the third ring 40 into abutting engagement with the top ring 20. "Engage" or "engaging", when used in reference to this structural relationship between the third ring 40 and the top ring 20, can mean either (a) directly contacting the material of the ring, or (b) indirectly contacting the material of the ring, through one or more intervening materials, such as the top portions 62 and 122 of the outer and inner fabric coverings 60 and 120, respectively—thus, contacting the fabric directly and contacting the ring 20 itself indirectly through the fabric.

In the embodiment of the invention illustrated in FIGS. 1–9, the third ring 40 engages the top ring 20 but does not contact the top ring directly, instead contacting directly the top end portion 62 of the outer fabric covering 60 through the top end portion 122 of the inner fabric covering 120.

The engagement of the third ring 40 with the top ring 20 urges or biases the top ring in a direction away from the bottom ring 30, that is, upward as viewed in FIG. 1. The third ring 40 thereby holds the top ring 20 spaced apart from the bottom ring 30 when the lampshade 10 is in this assembled state. The outer fabric covering 60 is thereby tensioned between the top ring 20 and the bottom ring 30. In addition, the inner fabric covering 120 is tensioned between the third ring 40 and the bottom ring 30 when the supports 70 are fully extended.

The outer fabric covering 60 and the inner fabric covering 120 define between them an annular cavity 132 (FIGS. 7 and 8) in the lampshade 10. The supports 70 are disposed in this cavity 132 between the two fabric coverings 60 and 120. As a result, the supports 70 are hidden from view when the lampshade 10 is in the assembled state (and, also, when the lampshade is in the collapsed state).

The third ring 40 may need to be rotated further about the central axis 22 relative to the top ring 20 and the bottom ring 30, after the third ring engages the top ring. The third ring 40 is preferably rotated until the supports 70 are generally linear or upright, as viewed in FIG. 1, for example.

When all the supports 70 are positioned in this manner, the lampshade is in the assembled state. The outer fabric covering 60 is tensioned between the top ring 20 and the bottom ring 30. The inner fabric covering 120 is tensioned between the third ring 40 and the bottom ring 30. The supports 70 act to apply force in a direction between the top ring 20 and the bottom ring 30 to maintain the top ring and the bottom ring spaced from each other and to tension the fabric coverings 60 and 120.

Figure 10:
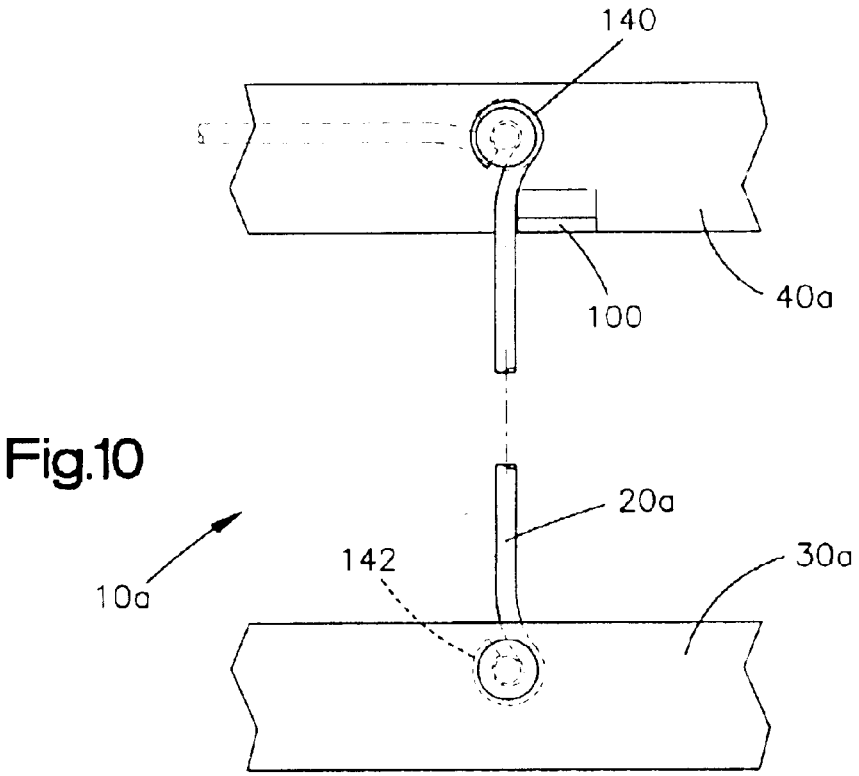
FIG. 10 is a view similar to FIG. 9 showing the attachment of certain parts of the frame of a lampshade that is constructed in accordance with a second embodiment of the invention.

FIG. 10 illustrates portions of a lampshade 10*a* constructed in accordance with a second embodiment of the invention. The lampshade 10*a* is generally similar in construction to the lampshade 10, and its variations, as described above in terms of structure, manufacture, and use. In the lampshade 10*a*, however, the supports 70*a* are formed as wires 70*a*, rather than bands 70. The wires 70*a* are preferably elastic, or resilient, like the bands 70.

Each wire 70*a* (FIG. 10) has an upper end portion 140 formed as a loop that extends around the shank of the upper rivet 90. Each wire 70*a* has a lower end portion 142 formed as a loop that extends around the shank of the lower rivet 110. The supports 70*a* are pivotally connected to the third ring 40 and to the bottom ring 30.

From the above description of the invention, those skilled in the art will perceive improvements, changes, and modifications in the invention. Such improvements, changes, and modifications within the skill of the art are intended to be included within the scope of the appended claims.

Having described the invention, we claim:

1. A lampshade having an assembled state and a collapsed state, said lampshade comprising:

a first ring;

a second ring spaced apart from said first ring when said lampshade is in the assembled state;

a first fabric covering interconnecting said first and second rings and extending between said first and second rings when said lampshade is in the assembled state;

a third ring located adjacent said first ring when said lampshade is in the assembled state; and a plurality of supports connected between said second ring and said third ring, each one of said supports having a first end portion movably connected to said second ring and a second end portion movably connected to said third ring, said supports holding said second and third rings spaced from each other when said lampshade is in the assembled state, said supports urging said third ring into engagement with said first ring thereby to hold said first ring spaced apart from said second ring when said lampshade is in the assembled state.

2. A lampshade as set forth in claim 1 further comprising a center ring located radially inward of said third ring and a plurality of arms extending radially between said center ring and said third first ring, said radial arms fixedly interconnecting said center ring and said first ring.

3. A lampshade as set forth in claim 1 wherein said supports are springs.

4. A lampshade as set forth in claim 3 wherein said supports are bands.

5. A lampshade as set forth in claim 3 wherein said supports are wires.

6. A lampshade as set forth in claim 1 wherein said supports are riveted to said third ring and to said bottom ring.

7. A lampshade having an assembled state and a collapsed state, said lampshade comprising:

a first ring;

a second ring spaced apart from said first ring when said lampshade is in the assembled state;

a first fabric covering interconnecting said first and second rings and extending between said first and second rings when said lampshade is in the assembled state;

a third ring located adjacent said first ring when said lampshade is in the assembled state; and a plurality of supports connected between said second ring and said third ring, each one of said supports having a first end portion movably connected to said second ring and a second end portion movably connected to said third ring, said supports holding said second and third rings spaced from each other when said lampshade is in the assembled state, said supports urging said third ring into engagement with said first ring thereby to hold said first ring spaced apart from said second ring when said lampshade is in the assembled state;

further comprising a second fabric covering interconnecting said second and third rings, said second fabric covering extending between said second and third rings when said lampshade is in the assembled state, said supports being disposed between said first fabric covering and said second fabric covering when said lampshade is in the assembled state.

8. A lampshade as set forth in claim 7 wherein said first fabric covering is tensioned between said first and second rings when said lampshade is in the assembled state, and said second fabric covering is tensioned between said second and third rings when said lampshade is in the assembled state.

9. A lampshade having an assembled state and a collapsed state, said lampshade comprising:

a first ring;

a second ring spaced apart from said first ring when said lampshade is in the assembled state;

a first fabric covering interconnecting said first and second rings and extending between said first and second rings when said lampshade is in the assembled state;

a third ring located adjacent said first ring when said lampshade is in the assembled state; and a plurality of support connected between said second ring and said third ring, each one of said supports having a first end portion movably connected to said second ring and a second end portion movably connected to said third ring, said supports holding said second and third rings spaced from each other when said lampshade is in the assembled state, said supports urging said third ring into engagement with said first ring thereby to hold said first ring spaced apart from said second ring when said lampshade is in the assembled state;

wherein said first fabric covering has a first portion contacting said first ring, said third ring contacting said first portion of said fabric covering thereby to engage said first ring when said lampshade is in the assembled state.

10. A lampshade having an assembled state and a collapsed state, said lampshade comprising:

a bottom ring;

an outer fabric covering connected with said bottom ring;

an inner fabric covering connected with said bottom ring;

a top ring;

said outer fabric covering being connected with said top ring and extending between said bottom ring and said top ring when said lampshade is in the assembled state;

a third ring;

said inner fabric covering being connected with said third ring and extending between said bottom ring and said third ring when said lampshade is in the assembled state; and a plurality of supports connected between said bottom ring and said third ring, said supports holding said bottom ring and said third ring spaced from each other when said lampshade is in the assembled state, said supports urging said third ring into engagement with said top ring thereby to hold said top ring spaced apart from said bottom ring when said lampshade is in the assembled state.

11. A lampshade as set forth in claim 10 wherein said supports are springs.

12. A lampshade as set forth in claim 10 wherein said supports are pivotally connected to said bottom ring and to said third ring.

13. A lampshade having an assembled state and a collapsed state, said lampshade comprising:

a bottom ring;

an outer fabric covering connected with said bottom ring;

an inner fabric covering connected with said bottom ring;

a top ring;

said outer fabric covering being connected with said top ring and extending between said bottom ring and said top ring when said lampshade is in the assembled state;

a third ring;

said inner fabric covering being connected with said third ring and extending between said bottom ring and said third ring when said lampshade is in the assembled state; and a plurality of supports connected between said bottom ring and said third ring, said supports holding said bottom ring and said third ring spaced from each other when said lampshade is in the assembled state, said supports urging said third ring into engagement with said top ring thereby to hold said top ring spaced apart from said bottom ring when said lampshade is in the assemble state;

wherein said outer fabric covering has an end portion contacting said top ring, said inner fabric covering having an end portion contacting said third ring, said inner fabric covering on said third ring contacting said outer fabric covering on said top ring thereby to engage said top ring when said lampshade is in the assembled state.

14. A lampshade having an assembled state and a collapsed state, said lampshade comprising:

a bottom ring;

an outer fabric covering connected with said bottom ring;

an inner fabric covering connected with said bottom ring;

a top ring;

said outer fabric covering being connected with said top ring and extending between said ring and said top ring when said lampshade is in the assembled state;

a third ring;

said inner fabric covering being connected with said third ring and extending between said bottom ring and said third ring when said lampshade is in the assemble state; and a plurality of supports connected between said bottom ring and said third ring, said supports holding said bottom ring and said third ring spaced from each other when said lampshade is in the assembled state, said supports urging said third ring into engagement with said top ring thereby to hold said top ring spaced apart from said bottom ring when said lampshade is in the assembled state;

wherein said supports are elastic and are disposed between said inner fabric covering and said outer fabric covering when said lampshade is in the assembled state.

15. A lampshade having an assembled state and a collapsed state, said lampshade comprising:

a bottom ring;

an outer fabric covering connected with said bottom ring;

an inner fabric covering connected with said bottom ring;

a top ring;

said outer fabric covering being connected with said top ring and extending between said bottom ring and said top ring when said lampshade is in the assembled state;

a third ring;

said inner fabric covering being connected with said third ring and extending between said bottom ring and said third ring when said lampshade is in the assembled state; and a plurality of supports connected between said bottom ring and said third ring, said supports holding said bottom ring and said third ring spaced from each other when said lampshade is in the assembled state, said supports urging said third ring into engagement with said top ring thereby to hold said top ring spaced apart from said bottom ring when said lampshade is in the assembled state, wherein said outer fabric covering is tensioned between said top and bottom rings when said lampshade is in the assembled state, and said inner fabric covering is tensioned between said bottom and third rings when said lampshade is in the assembled state.

16. A lampshade as set forth in claim 15 wherein said third ring is rotatable and movable axially relative to said bottom ring during movement of said lampshade from the collapsed state to the assembled state.

17. A lampshade having an assembled state and a collapsed state, said lampshade comprising:

a bottom ring;

a top ring movable relative to said bottom ring between (a) a first position in which said top ring is adjacent to and substantially parallel to said bottom ring and (b) a second position in which said top ring is spaced apart from and substantially parallel to said bottom ring, said top ring being in the first position when said lampshade is in the collapsed state, said top ring being in the second position when said lampshade is in the assembled state;

a third ring movable relative to said bottom ring and to said top ring between (a) a first position in which said third ring is adjacent to and substantially coplanar with said bottom ring and said top ring and (b) a second position in which said third ring is adjacent to said top ring and is spaced apart from and substantially parallel to said bottom ring, said third ring being in the first position when said lampshade is in the collapsed state, said third ring being in the second position when said lampshade is in the assembled state;

an outer fabric covering connected between said bottom ring and said top ring;

an inner fabric covering connected between said bottom ring and said third ring; and a plurality of supports each having opposite end portions movably connected to said bottom ring and to said third ring.

18. A lampshade as set forth in claim 17 wherein said supports are pivotally connected to said bottom ring and to said third ring.

19. A lampshade as set forth in claim 17 wherein said supports are springs.

20. A lampshade as set forth in claim 17 wherein said supports are disposed between said inner fabric covering and said outer fabric covering when said lampshade is in the assembled state.

* * * * *